United States Patent [19]

Urban

[11] 4,150,868

[45] Apr. 24, 1979

[54] BATTERY CONNECTOR CLAMP

[76] Inventor: George H. Urban, 1430 N. Dakota Ave., Sioux Falls, S. Dak. 57102

[21] Appl. No.: 860,551

[22] Filed: Dec. 14, 1977

[51] Int. Cl.[2] ..... H01R 11/26

[52] U.S. Cl. ..... 339/233; 339/265 R

[58] Field of Search ..... 339/95 B, 225, 231, 339/233, 265 R, 263 B

[56] References Cited

U.S. PATENT DOCUMENTS

| | | | |
|---|---|---|---|
| 2,425,764 | 8/1947 | Tenney | 339/233 X |
| 2,887,668 | 5/1959 | Sherno | 339/225 X |

FOREIGN PATENT DOCUMENTS

| | | | |
|---|---|---|---|
| 1108467 | 8/1957 | France | 339/265 R |
| 85044 | 4/1957 | Netherlands | 339/265 R |

*Primary Examiner*—Roy Lake
*Assistant Examiner*—E. F. Desmond
*Attorney, Agent, or Firm*—Frank C. Maley

[57] ABSTRACT

A battery connector clamp has a cooperating pair of solid lead jaws having abutting inner ends that clampingly encircle a battery post and having grooved outer side surfaces to seat the parallel shanks of a U-bolt with the threaded ends of the shanks being engaged by nuts so as to secure a clamping bar against the outer end of one jaw and in clamping cooperation with the bight portion of the U-bolt which is seated in a groove in the outer end of the other jaw that has a bore to receive the bared end of a conductor cable.

3 Claims, 4 Drawing Figures

BATTERY CONNECTOR CLAMP

BACKGROUND OF THE INVENTION (1) Field of the Invention

The present invention generally appertains to new and novel improvements in clamps and especially relates to a new and novel battery connector clamp or battery terminal connector for the purpose of connecting a conductor cable to the conventional post of a storage battery.

(2) State of the Art

Battery terminals are subject to extreme corrosive action and, thus, it is highly desirous to form a battery connector clamp so that it will be resistant to such corrosive action. Therefore, it is desirous to form the clamp from metal. But, conventional battery connectors are in the form of a U-shaped clamp or split socket having substantially parallel legs that are clamped onto a battery post by a bolt assembly passed through openings in the legs. Thus, such connectors must be constructed from soft pliable metal so that the legs can be moved towards each other in clampingly engaging a battery post under the tightening action of the bolt unit. Due to the soft nature of the metal, the connectors are subject to deformation and the legs are prone to slip on the post. Further, the legs of such connectors do not grip the post with sufficient force.

SUMMARY OF THE INVENTION

The primary object of the present invention is to provide a simple, compact and effective battery terminal or battery connector clamp that will insure a very tight and positive electrical connection between a conductor cable and the battery post.

In accordance with the present invention, there is provided a battery connector clamp that includes lead blocks or jaws which are shaped in a complemental fashion so as to completely encircle a battery post and which are clamped tightly against each other and around the post by means of a U-bolt which has it shanks seated in grooves formed in the outer side surfaces of the jaws and a bight portion clampingly seated in a groove formed in the outer end of one jaw with the threaded ends of the shanks of the bolt supporting a clamping bar that engages the outer end of the other jaw in clamping cooperation with the bight portion and which is secured against such end in clamping relation with the bight portion by nuts on the threaded ends of the shanks.

The grooves in the outer side surfaces of the jaws are in alignment with the groove in the outer end of the one jaw. Such outer end is arcuate to correspond to the curvature of the bight portion of the U-bolt. The grooves in the side surfaces are formed of increasing depths from their inner ends communicating with the arcuate groove to their outer ends at the outer end of the other jaw. The opposing side surfaces of the other jaw taper outwardly from the inner end of such jaw to the outer end for strenghtening purposes and also to produce the deeper portions of the grooves in a way so as to protectively house the outer free end portions of the shanks of the U-bolt. The inner ends of the jaws are flat so as to tightly abut against each other and have complemental cutouts that form an opening to receive the battery post. The arcuate end of the one jaw is formed above the groove therein with a projecting lip that cooperates with the bolt bight portion seated in the arcuate groove to protect the end of the conductive cable with such end being fitted in a bore in the one jaw in a manner to extend into the opening for contacting the battery post.

DESCRIPTION OF THE PREFERRED EMBODIMENT

Figure 1:
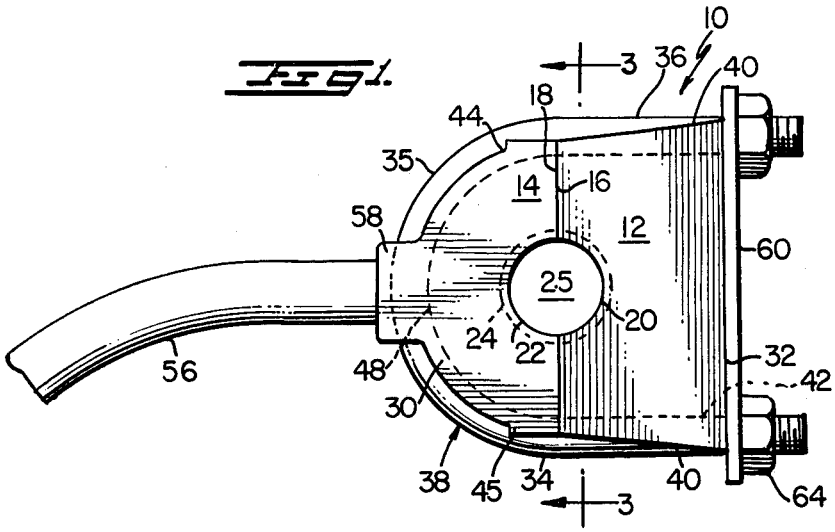
FIG. 1 is a top plan view of the battery connector clamp of the present invention which is shown clamped on a battery post.
Figure 3:
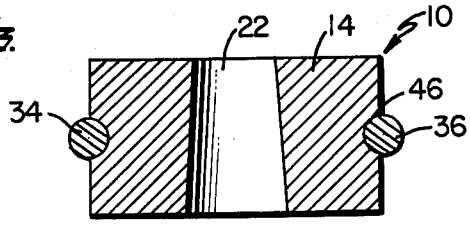
FIG. 3 is a vertical, cross-sectional view taken substantially on line 3—3 of FIG. 1.
Figure 4:
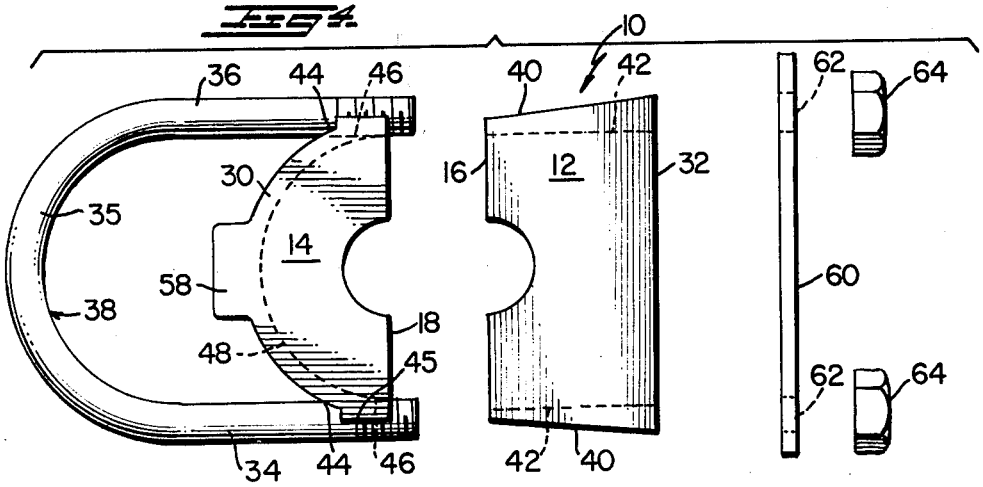
FIG. 4 is a top plan view of the battery connector clamp; shown in an unassembled condition.

Referring now more particularly to the accompanying drawing, the battery connector clamp 10 is composed of a cooperating pair of blocks or jaws 12 and 14. The jaws are of solid construction and are formed from lead or other similar non-corrosive hard metal. The inner end 16 of the clamping jaw 12 is flat and is adapted to abut tight against the inner flat end 18 of the jaw 14, as shown in FIG. 1. The complemental inner ends 16 and 18 are formed with semicircular cut-outs 20 and 22 which cooperate in the clamped position of the jaws 12 and 14 to form a circular opening 24 for receiving a battery post 25 shown in dotted lines in FIG. 1. The opening 24 is shaped so as to clampingly receive the battery post 25 and is of a larger diameter at the bottom face 26 than at the top face 28 of the clamp 10, as shown in FIG. 3. The clamping jaw 14 is of semicircular configuration with its flat inner end 18 and an arcuate outer end 30 while the member 12 is of substantially rectangular shape having the flat inner end 16 and a parallel flat outer end 32. Both of the jaws are of similar thickness with such being substantially equal to the length of the battery post.

The clamping jaws 12 and 14 have grooved outer sides provided to receive the parallel shanks 34 and 36 of a U-bolt 38. The outer sides 40 of the jaw 12 diverge outwardly from the inner end 16 to the outer end 32 so that the sides at the outer end portion 32 are wider than at the inner end portion 16 for stiffening and ridigification purposes and also so that the grooves in the sides of the jaw 12 are of a greater depth at the outer end portion than at the inner end portion. The outer free end portions of the shanks 34 and 36 of the bolt 38 are completely housed within the outer end portions of the grooves 42 adjacent the outer end 32 of the jaw 12. Thus, the grooves 42 increase in depth towards the outer end 32 and reach a depth at such end that is at least equal to the diameter of the shanks of the bolt.

Figure 2:
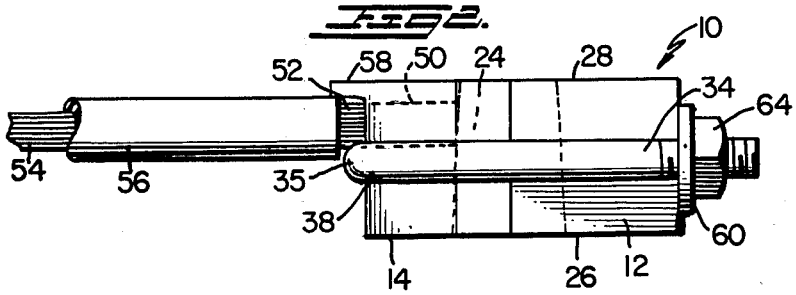
FIG. 2 is a side elevational view thereof.

The opposing sides 44 of the clamping jaw member 14 have grooves 46 which are in alignment with the grooves 42 for the reception of the shanks of the U-bolt 38, as shown clearly in FIG. 1. The sides 44 adjacent the inner end 18 of the jaw 14 have enlargements 45 that are of the same thickness as the inner end portions of the sides 40 of the jaw 12 with such enlargements having grooves that complement the inner ends of the grooves 42. The arcuate outer end 40 of the clamping jaw 14 is provided with an arcuate groove 48 in which the bight portion 35 of the bolt is fitted with the groove being formed below the bore 50 in which the bared end 52 of a conductive cable 54 is fixedly mounted, the cable being enclosed by a lead sheathing 56. The cable end 52 is mounted in the bore 50 above the bight portion 35 and below a lip 58 formed centrally on the top of the outer end of the jaw 14 with the end portion of the cable being protectively positioned between the bight portion and the rearwardly projecting lip 58, as shown in FIG. 2.

A flat clamping bar 60 is provided and is formed at its end portions with apertures 62 that fit on the outer end portions of the shanks 34 and 36 of the U-bolt 38 in a manner so that the flat clamping bar 60 extends between the shanks and fits tightly against the flat outer end 32 of the clamping jaw 12. The outer ends of the free end portions of the bolt shanks are exteriorly threaded to receive nuts 64 which bear against the clamping bar 60 and whereby the bar 60 cooperates with the bight portion 35 of the bolt to tightly clamp the clamping jaws 12 and 14 on the battery post 25.

In use, the jaw 14 has the end of the conductive cable attached thereto and the jaw is positioned on one side of the battery post 25 with the jaw 12 being disposed on the other side. The jaws are brought together so as to encircle the post and the shanks 34 and 36 of the U-bolt 38 are slid into the aligned grooves 46 and 42 until the bight portion is seated firmly within the arcuate groove 48 in the outer end 30 of the jaw 14. In such position the outer threaded free ends of the shanks 34 and 36 of the U-bolt 38 project beyond the outer end of the jaw 12 and the inner ends 18 and 16 of the jaws are in tight abutting relation. The clamping bar 60 is then placed on the ends of the shanks and the nuts 64 are screwed onto such shank ends until the bar is forced tight against the flat outer end 32 of the jaw 12. The jaws are tightened onto the post so that the post will not smoke and so that the jaws cannot become accidentally loosened.

Thus, when the jaws are tightened on both sides of the post so as to completely clampingly encircle the post, the clamp will stay tight. Thus, the battery will not lose its power.

The clamp 10 can be formed with the cable end molded in the jaw 14 or the jaw can accommodate a replacement cable. Also, while the clamp 10 can be put on one end of a conductor cable to fix the cable to a battery post, it is envisioned that the clamp can be on opposite ends of a cable used to couple a pair of batteries together.

Thus, it is to be understood that the foregoing description and the illustration in the drawing merely relate to an exemplary form and environment of the present invention, which is solely limited by the terms and scope of the appended claims.

I claim:

1. A battery connector clamp comprising a pair of solid jaws formed from hard metal and adapted to be positioned on opposite sides of a battery post, said jaws being of the same thickness which is substantially equal to the height of the post and said jaws having inner abutting ends formed with cooperating opening means to receive the battery post and having outer free ends, the outer end of one jaw being substantially semi-circular and being formed therethrough with a bore for fixedly receiving an end of a cable which is adapted to communicate with the opening means to engage the battery post and the outer end of the other jaw being substantially flat, a U-bolt having an arcuate bight portion and substantially parallel shanks, said outer end of the one jaw having a groove for seating the bight portion of the bolt, said other jaw having opposing sides formed with grooves for the reception of the shanks of the bolt, said groove in the outer end of the one jaw being arcuate and having its ends in the opposing sides of the jaw and disposed in axial alignment with the grooves in the other jaw with the grooves in the other jaw increasing in depth from the inner end of the said jaw to the outer end thereof and being of a depth adjacent the outer end at least equal to the diameters of the bolt shanks seated therein, said shanks having outer free end portions extending beyond the outer end of the other jaw when the jaws are abuttingly clamped on the battery post, securing members adjustably disposed on the end portions of the shanks and a clamping member movably carried by the shank end portions and against which the securing members bear to tighten the clamping member against the outer end of the other jaw with the clamping member being in clamping cooperation with the bight portion of the bolt so as to clamp the jaws tightly onto the post, and means carried by the outer end of the one jaw and extending therefrom over the cable end to cooperate with the bight portion of the bolt in protecting the cable end as it protrudes from the bore.

2. The invention of claim 1 wherein said last means includes a protruding integral lip on the outer end of the one jaw above the bore with the cable end fitted between the bight portion of the bolt and the lip.

3. The invention of claim 1 wherein the grooves in the other jaw at the inner end thereof are of the same depth as the grooves in the sides of the one jaw so as to permit the shanks to slide easily between the two jaws in assembling the jaws onto the battery post.

* * * * *